US010287795B2

(12) United States Patent
Fraioli, Sr. et al.

(10) Patent No.: US 10,287,795 B2
(45) Date of Patent: May 14, 2019

(54) RACEWAYS FOR FABRIC STRUCTURES

(71) Applicant: Air Structures American Technologies, Inc., Rye Brook, NY (US)

(72) Inventors: Donato Michael Fraioli, Sr., White Plains, NY (US); Donato Anthony Fraioli, Pound Ridge, NY (US); Donato Joseph Fraioli, Pound Ridge, NY (US)

(73) Assignee: Air Structure American Technologies, Inc., Rye Brook, NY (US)

( * ) Notice: Subject to any disclaimer, the term of this patent is extended or adjusted under 35 U.S.C. 154(b) by 0 days.

(21) Appl. No.: 15/450,632

(22) Filed: Mar. 6, 2017

(65) Prior Publication Data

US 2018/0251999 A1 Sep. 6, 2018

(51) Int. Cl.

| | |
|---|---|
| ***E04H 15/20*** | (2006.01) |
| *E04B 1/342* | (2006.01) |
| *E04B 1/32* | (2006.01) |
| *E02D 27/02* | (2006.01) |

(52) U.S. Cl.

CPC ..... *E04H 15/20* (2013.01); *E02D 27/02* (2013.01); *E04B 1/32* (2013.01); *E04B 1/3205* (2013.01); *E04B 1/342* (2013.01); *E04H 2015/205* (2013.01)

(58) Field of Classification Search

CPC ..... E04H 15/20; E04H 2015/205; E04B 1/34; E04B 1/342; E04B 1/32

USPC ... 52/2.22, 2.23, 2.24, 2.25, 2.26, 2.11, 6, 1, 52/80.1, 80.2, 81.1

See application file for complete search history.

(56) References Cited

U.S. PATENT DOCUMENTS

| | | | | |
|---|---|---|---|---|
| 3,116,746 A * | 1/1964 | Bird | E04H 15/22 | 135/115 |
| 3,169,542 A * | 2/1965 | Neumark | E04H 15/22 | 52/169.2 |
| 3,227,169 A * | 1/1966 | Fischer | E04H 15/20 | 52/2.19 |
| 3,432,609 A * | 3/1969 | Brion, Jr. | E04H 15/20 | 135/115 |
| 3,744,191 A * | 7/1973 | Bird | E04H 15/22 | 52/2.23 |
| 3,857,209 A * | 12/1974 | Milliken | E04H 15/22 | 160/328 |

(Continued)

*Primary Examiner* — Joshua K Ihezie

(74) *Attorney, Agent, or Firm* — Heslin Rothenberg Farley & Mesiti P.C.

(57) ABSTRACT

Fabric structures with raceways and methods of making same are disclosed. In some embodiments, the fabric structures are air supported structures that form an enclosure via internal pressurized air. The air supported structures include an outer membrane that defined an outer surface of the structure. The air supported structures further include a plurality of inner segments formed of tab members coupled to and extending from the outer membrane toward the interior of the enclosure, and at least one inner liner panel coupled to and extending between adjacent tab members spaced inwardly from the outer membrane to form at least one air pocket therebetween. An attachment portion of the tab members extends inwardly past the at least one inner liner panel into the enclosure and forms at least one hardware attachment point.

16 Claims, 10 Drawing Sheets

(56) References Cited

U.S. PATENT DOCUMENTS

| | | | | | |
|---|---|---|---|---|---|
| 3,924,363 | A * | 12/1975 | Candle | E04H 15/22 | 52/2.19 |
| 3,936,984 | A * | 2/1976 | Yando | E04H 15/20 | 52/2.19 |
| 4,041,653 | A * | 8/1977 | Rain | E04H 15/22 | 135/115 |
| 4,065,889 | A * | 1/1978 | Fraioli | E04H 15/20 | 160/DIG. 7 |
| 4,155,967 | A * | 5/1979 | South | E04B 1/169 | 249/65 |
| 4,186,530 | A * | 2/1980 | Fraioli | E04H 15/20 | 52/2.19 |
| 4,324,074 | A * | 4/1982 | South | E04B 1/3505 | 264/34 |
| 4,477,503 | A * | 10/1984 | Fraioli | E04H 15/22 | 428/102 |
| 5,479,743 | A * | 1/1996 | Queen | E04H 15/20 | 52/2.22 |
| 6,070,366 | A * | 6/2000 | Pierson | E04H 15/22 | 52/2.17 |
| 2004/0045227 | A1* | 3/2004 | South | E04B 1/169 | 52/80.1 |
| 2005/0210767 | A1* | 9/2005 | DeFever | E04B 1/169 | 52/80.1 |
| 2007/0094937 | A1* | 5/2007 | Pedretti | E01D 15/122 | 52/2.11 |
| 2007/0271854 | A1* | 11/2007 | Wiegand | E04H 15/20 | 52/2.11 |
| 2013/0318885 | A1* | 12/2013 | Griffis | E04B 1/34357 | 52/2.11 |

* cited by examiner

RACEWAYS FOR FABRIC STRUCTURES

FIELD OF THE INVENTION

The present disclosure generally relates fabric structures, and more particularly to fabric structures with integrated internal raceways.

BACKGROUND OF THE INVENTION

Fabric structures are known. These structures are generally comprised of a main or outer fabric, sheet, member or membrane which defines an enclosure. The main flexible sheet-like membrane may be formed from a plurality of panels which are joined to each other at their edges to form an envelope of any size and shape. The outer surface of the outer flexible membrane typically forms the exterior surface of the structures.

Three types of fabric structures exist: air-supported fabric structures, frame supported fabric structures, and cable supported fabric structures. In air supported structures, the main outer membrane is supported by internal air pressure formed within the enclosure. By forming an internal air pressure within the enclosure that is greater than the air pressure outside of the structure, the outer membrane (and structures attached thereto) is supported in an elevated position to form a dome or dome-like structure. In frame supported structures, a rigid internal framework is utilized as a loadbearing structure to support the main outer membrane in an elevated position. The outer membrane thereby lays over, and is coupled to, the internal frame. The internal frame and the outer membrane thereby combine to form the enclosure. Cable supported fabric structures utilize cables or other tensile members to support the main outer membrane in an elevated position. The cables are typically positioned exterior or in line with the outer membrane, but may positioned with the interior of some structures. The outer membrane may or may not be in tension in cable supported fabric structures. In addition to cable or other tensile members, some cable supported fabric structures may include compression elements (e.g., struts and/or poles) to support the outer membrane and form the enclosure.

The outer flexible panels forming the outer membrane of such fabric structures are typically made from a strong, durable, light-weight material that is weather resistant and resistant to airborne pollutants. Additionally, it is desirable that the material forming the outer membrane is flexible and configured such that adjacent panels can be coupled together to form a relatively strong composite structure. Fabric structures utilizing such material and panels advantageously resist tearing, such as tearing along the joints where the outer panels are joined.

It is also desirable for some applications of fabric structures to include one or more layers of sheet-like flexible internal liners positioned interior of the main outer membrane. The inner surface of the inner-most internal liner may form an interior surface of the structures. These internal liners are typically comprised of inner liner panels attached to the outer membrane, and define at least one air pocket or space between the internal liner panels and the outer membrane. When two or more layers of liner panels are utilized, at least one additional air pocket is formed between the liners panels themselves. The air pockets formed at least in part by the inner liner panels act as one or more thermal barriers that insulate the enclosure formed by the fabric structure.

While inner liners advantageously increase the insulative quality of fabric structures, the numerous attachment points between the inner liner panels and the outer panels represent potential weak points of the structures. For example, the material of the inner liner panels and the main outer panels forming the outer membrane may need to be compatible to ensure they can be securely joined to each other and behave similarly during use to prevent undue stress on the joints therebetween.

In addition to insulating the interior enclosure formed by the structures, the pockets formed between the outer main panels and adjacent inner liner panels, or between multiple layers of inner liner panels if provided, are typically utilized to house electrical wires, piping or other hardware that is typically used with the structures. For example, electrical wiring that is used to power lighting or other electrical devices that hang from the inner surface of the enclosure (or are otherwise elevated and provided proximate to the inner surface of the enclosure) are typically placed loosely in the pockets. Such an arrangement is unsightly as the wiring and/or other hardware typically leaves an impression or indent in the panels that can be seen from within the enclosure. Further, the inner panels may be at least translucent such that the unattractive loosely arranged wires and/or other hardware are visible from within the enclosure.

Occasionally, individual hanging tabs are attached to the interior surface of inner-most inner panels to provide attachment points for hardware. The hanging tabs may each include a portion that is attached to the interior surface of an inner-most inner panel and a free portion that extends therefrom (typically extending downwardly therefrom). The free portion may have an aperture through which the hardware may extend or through which a clip or other mechanism may be coupled (and then coupled to hardware). Such hanging tabs may be utilized in addition to passing portions of hardware within the insulating pockets or to replace such arrangements. Unfortunately, these hanging tabs also have numerous drawbacks. For example, the tabs themselves are unsightly, and any hardware that extends thereto and therefrom is visible and unattractive. Further, installation of the tabs is labor intensive, and thereby time consuming and expensive, as each tab must be individually attached to the inner panels in desired locations after the fabric structure has been erected. Still further, typical tabs can only accommodate relatively light loads as the structural integrity of the tabs themselves and the integrity of the attachment between the tabs and the interior surface of the inner panels may be relatively weak. For example, typical tabs are heat welded to the interior surface of the inner panels after the structures are erected, and therefore consistent welds cannot be ensured.

Thus, a need exists for raceways, conduits or other structures that provide secure, attractive, elevated attachment points and raceways/conduits extending thereto and therefrom for hardware within fabric structures, such as air supported fabric structures, frame supported fabric structures, and/or cable supported fabric structures. In this way, raceways/conduits or other structures that provide secure attachment points for hardware at or proximate to the interior surface of inner panels of fabric structures are desirable. Further, raceways/conduits or other structures that hide and/or organize in an attractive manner wiring, piping or other similar mechanisms associated with hardware utilized with fabric structures are also desirable.

While certain aspects of conventional technologies have been discussed to facilitate disclosure, Applicant in no way disclaims these technical aspects, and it is contemplated that the claimed inventions may encompass one or more conventional technical aspects.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

The present disclosure may address one or more of the problems and deficiencies of the art discussed above. However, it is contemplated that the present disclosure may prove useful in addressing other problems and deficiencies in a number of technical areas. Therefore, the claimed inventions and present disclosure should not necessarily be construed as limited to addressing any of the particular problems or deficiencies discussed herein.

Briefly, the present disclosure satisfies the need for improved internal hardware attachment mechanisms for fabric structures, such as air supported fabric structures, frame supported fabric structures, and/or cable supported fabric structures, and processes of making the same, that provide secure, attractive, elevated attachment points for hardware within the structures.

Generally, the internal hardware attachment mechanisms are each formed from a sheet-like flexible tab member that is attached to and extends from at least one outer main panel of a fabric structure. The tab member extends away from an interior surface of the least one outer main panel inwardly towards the interior of the enclosure and/or downwardly towards the ground. The tab also extends laterally across the width or length of the fabric structure, depending upon the orientation or design (e.g., shape) of the structure. At least one first inner liner panel of the fabric structure is attached to a first side or face of the tab member such that the at least one first inner liner panel is spaced from the interior surface of the adjacent at least one outer main panel. Similarly, at least one second inner liner panel of the fabric structure is attached to a second side or face of the tab member that opposes the first side or face thereof such that the at least one second inner liner panel is spaced from the interior surface of the adjacent at least one outer main panel. An attachment portion of the tab may extend past interior surfaces of the at least one first and second inner liner panels inwardly towards the interior of the enclosure and/or downwardly towards the ground. The attachment portion of the tab may form at least one aperture.

The attachment portion of the tabs of the fabric structure may thereby provide integrated and secure hardware attachment mechanisms proximate to the interior surface of the inner-most inner panels. For example, the at least one aperture of the attachment portion of the tab may be configured to allow hardware to pass therethrough and, thereby, be supported by the tab. In some embodiments, the attachment portion of the tab may form at least one conduit or raceway through which hardware (e.g., wire, piping, attachment rod, clip, etc.) may extend or be carried within. For example, the attachment portion may be folded over upon itself and a portion of the overlapped portions may be coupled (e.g., heat welded) to form a raceway. The at least one aperture may be in communication with the at least one conduit such that elongate hardware carried within the conduit can extend into the enclosure via the at least one aperture (and additional hardware coupled to the portion positioned within the enclosure). Similarly, a support member may be positioned within the at least one conduit such that it extends past the at least one aperture to allow hardware to be hung thereon via the at least one aperture. In some other embodiments, the at least one aperture may extend through two portions of the conduit and allow hardware to extend therethrough to support such hardware.

In one aspect, the present disclosure provides an air supported structure forming an enclosure with internal pressurized air. The structure comprises an outer membrane defining an outer surface of the structure. The enclosure further comprises a plurality of inner segments formed of tab members coupled to and extending from the outer membrane toward the interior of the enclosure, and at least one inner liner panel coupled to and extending between adjacent tab members spaced inwardly from the outer membrane to form at least one air pocket therebetween. An attachment portion of the tab members extends inwardly past the at least one inner liner panel into the enclosure and forms at least one hardware attachment point.

In some embodiments, the attachment portion of the tab members include at least one aperture extending therethrough that forms at least one hardware attachment aperture. In some embodiments, the attachment portion of the tab members forms at least one conduit portion that forms at least one hardware conduit. In some such embodiments, the at least one conduit portion defines an elongate conduit that defines an elongate raceway configured to house hardware therein. In some such embodiments, the at least one conduit portion includes at least one aperture in communication with the raceway that is configured to allow the elongate hardware to extend into the enclosure via the at least one aperture. In some such embodiments, the attachment portion of the tab members include at least one aperture extending therethrough that is spaced from the at least one conduit portion that forms at least one hardware attachment aperture. In some such other embodiments, the attachment portion of the tab members include at least one aperture that extends therethrough that forms at least one hardware attachment aperture that is spaced from the at least one conduit portion. In some other embodiments, the structure defines a lateral width and a longitudinal length, and wherein at least one first tab member and the conduit portion thereof extends along the entirety of the lateral width of the structure. In some such embodiments, the conduit portion of the at least one first tab member includes a plurality the apertures in communication with the raceway that are spaced along the lateral width of the structure.

In some embodiments, a first portion of the attachment portion of the tab members is bent over and coupled to a second portion of the attachment portion proximate to the at least one inner liner panel to form the conduit portion thereof. In some such embodiments, the first portion of the attachment portion is a free end portion of the tab members. In some such other embodiments, the first and second portions of the attachment portion are heat welded together.

In some embodiments, the tab members are coupled to and extend from an inwardly-facing surface of the outer membrane. In some embodiments, the inner segments are each formed of a pair of tab members and at least one inner liner panel extending therebetween, and wherein adjacent inner segments share a common tab member. In some such embodiments, the at least one inner liner panel of each inner segment is coupled to and extends between a first face of a first tab member and a second face of a second tab member.

In some embodiments, the inner segments comprise a first inner liner panel inwardly spaced from the outer membrane forming a first air pocket between the outer membrane and the first inner liner panel, and a second inner liner panel inwardly spaced from the first inner liner panel forming a second air pocket between the second inner liner panel and the first inner liner panel. In some embodiments, the tab members are a sheet of flexible fabric material.

In another aspect, the present disclosure provides an air supported structure forming an enclosure with internal pressurized air. The structure comprises an outer membrane defining exterior and interior surfaces of the structure. The structure further comprises a plurality of tab members coupled to and extending from the interior surface of the outer membrane toward the interior of the enclosure, the plurality of tab members each including an attachment portion of that forms at least one elongate conduit configured to house hardware therein.

In one aspect, the present disclosure provides a method of forming an air supported structure that forms an enclosure via internal pressurized air. The method comprises obtaining an outer membrane that defines an outer surface of the structure. The method further comprises forming a plurality of inner segments formed of tab members coupled to and extending inwardly from the outer membrane, and at least one inner liner panel coupled to and extending between adjacent tab members spaced inwardly from the outer membrane. An attachment portion of the tab members extends inwardly past the at least one inner liner panel into the enclosure and forms at least one hardware attachment point.

In some embodiments, the method further comprises forming at least one aperture in the attachment portion of the tab members to form the at least one hardware attachment aperture. In some embodiments, the method further comprises forming at least one conduit portion from the attachment portion of the tab members to form at least one hardware conduit defining an elongate raceway.

These and other features and advantages of the present disclosure will become apparent from the following detailed description of the various aspects of the present disclosure taken in conjunction with the appended claims and the accompanying drawings.

BRIEF DESCRIPTION OF THE DRAWINGS

The present disclosure will hereinafter be described in conjunction with the following drawing figures, wherein like numerals denote like elements, and.

DETAILED DESCRIPTION OF THE INVENTION

Aspects of the present disclosure and certain features, advantages, and details thereof are explained more fully below with reference to the non-limiting embodiments illustrated in the accompanying drawings. Descriptions of well-known materials, fabrication tools, processing techniques, etc., are omitted so as to not unnecessarily obscure the present disclosure in detail. It should be understood, however, that the detailed description and the specific example (s), while indicating embodiments of the present disclosure, are given by way of illustration only, and are not by way of limitation. Various substitutions, modifications, additions and/or arrangements within the spirit and/or scope of the underlying inventive concepts will be apparent to those skilled in the art from this disclosure.

The present disclosure provides improved internal hardware containment and attachment mechanisms for air fabric structures (i.e., air supported fabric structures, frame supported fabric structures, and cable supported fabric structures), and processes of making the same, that provide secure, attractive, elevated attachment points and raceways/conduits extending therefrom and thereto for hardware within the structures.

Figure 1:
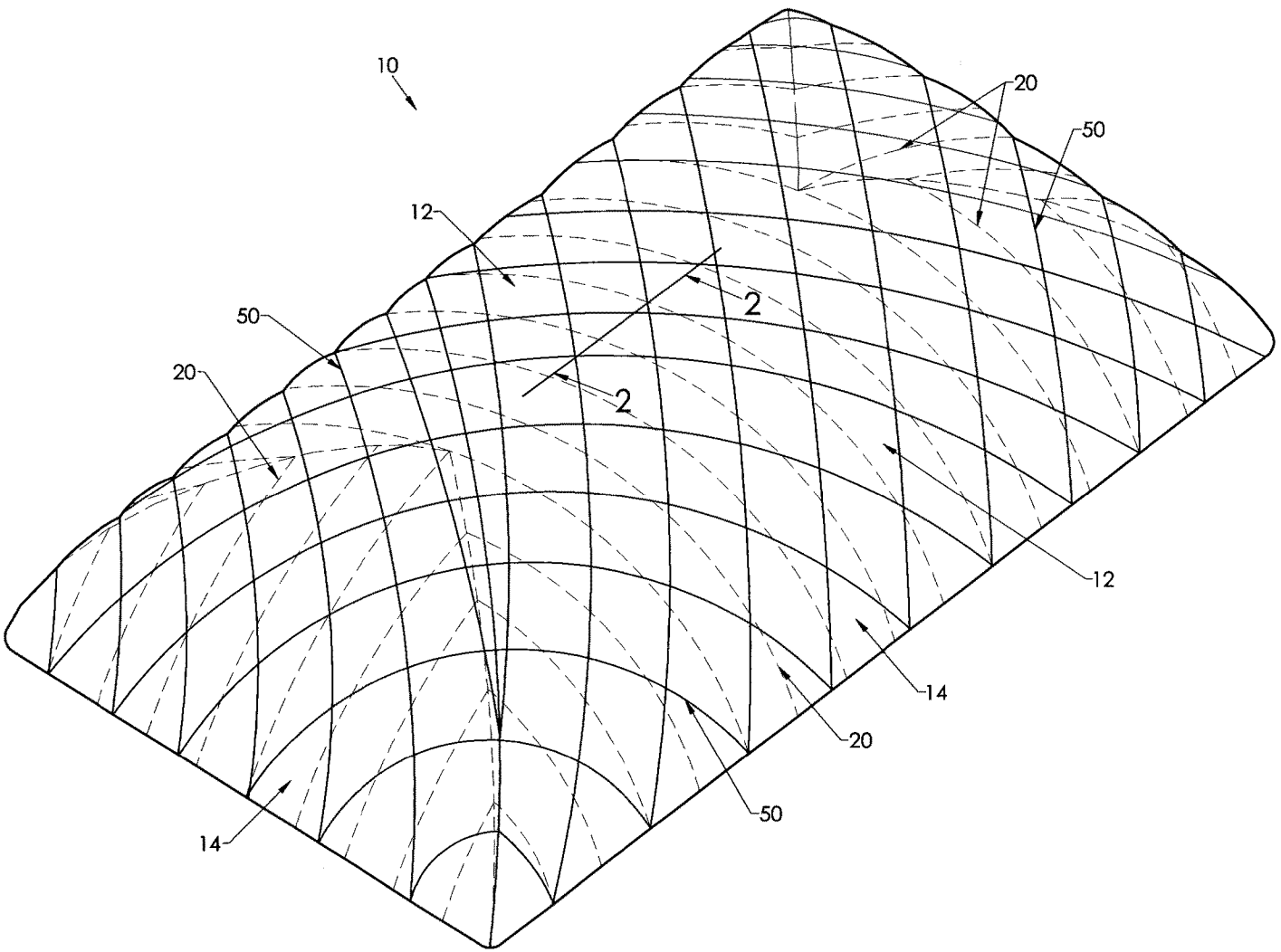
FIG. 1 is an elevational perspective view of a fabric structure according to the present disclosure.

As shown in FIG. 1, the present disclosure is directed to fabric or fabric-based structures or buildings 10. The fabric structures may be air supported fabric structures, frame supported fabric structures, or cable supported fabric structures. As shown in FIG. 1, in some embodiments the fabric structures 10 may be an air supported fabric structure that is supported by pressurized air pumped into the interior of the structure 10 to form an enclosure. The structures 10 may be utilized in myriad of differing way for any use, such as for permanent or temporary industrial, military, social and recreational uses.

These structures are composed of an outer membrane, shell or skin 12 and at least one inner layer of interior panels (as explained further below). The outer membrane 12 may be formed of a plurality of panels that are coupled or sealed to each other. The structures 10 (and thereby the outer membrane 12 and the inner liner panels) may be of any size and shape.

Figure 5:
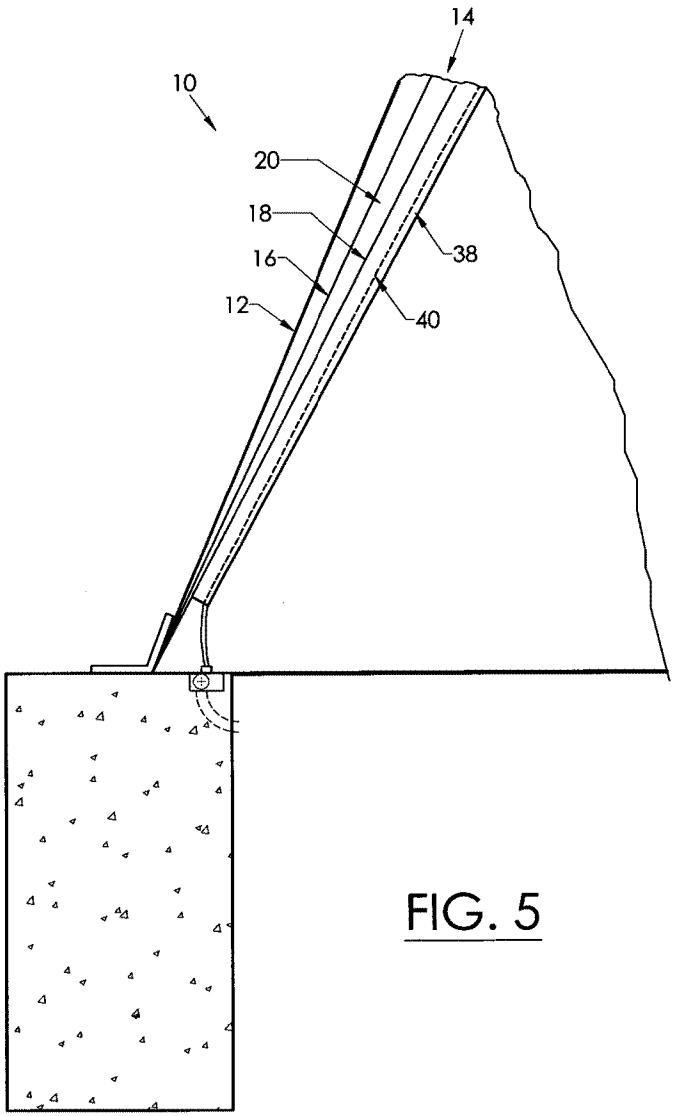
FIG. 5 is an enlarged portion of the cross-sectional view of FIG. 4.

At least the outer membrane 12 (and potentially the inner liner panels) may be anchored and sealed to the ground and/or to a base structure that extends to the ground, as shown in FIG. 5. At least the outer membrane 12 may be substantially airtight and form a substantially airtight enclosure extending between the outer membrane 12 and the ground and/or base structure on which the structure 10 is erected. In some other embodiments, such as for example with fabric structures other than air supported fabric structures (e.g., frame supported fabric structures or cable supported fabric structures), the outer membrane 12 may not be substantially airtight and may not form a substantially airtight enclosure.

In air supported structures 10, large capacity air blowers may be used to pump air into the interior of the structure 10 to maintain the air pressure within the structure 10 above the pressure acting on the exterior of the outer membrane 12 of the structure 10 (e.g., the local atmospheric pressure and any other applied loads). In this way, at least the outer membrane 12 of the air supported structure 10 may be maintained in tension by internal air pressure at a sufficient pressure that supports the outer membrane 12 above the ground and/or base structure to form the interior enclosure. For example, the blowers may replace any air which is lost from within the enclosure, such as any air that may flow through any perforations in the outer membrane 12, air which escapes when the doors or other opening of the structures 10 are opened, and air which escapes because of imperfect seals at the base of the structures 10 and about any designed openings, to maintain sufficient air pressure to maintain the interior enclosure. In some embodiments, the enclosure (e.g., formed in part by the outer membrane 12) is maintained at an inflation pressure that is sufficient to support the structure in an elevated position to form the interior enclosure. As one of ordinary skill in the art would appreciate, the necessary internal air pressure of a particular air supported structure may depend upon a number of factors, including but not limited to the weight of the structure (including components and hardware attached thereto), the external loads applied to the structure (e.g., the environmental conditions at the location of the structure), and the local air pressure at the location of the structure. The internal air pressure within the enclosure of the air supported structure 10 formed by at least the outer membrane 12 may be sufficient to make the structure 10 substantially rigid (i.e., rigidly support the weight of the outer membrane 12 and any elements or hardware coupled thereto or otherwise supported thereby) and to resist external pressure from wind, snow and other external loads.

It is noted that air-inflated fabric structures, which may be considered a type of frame supported fabric structures, significantly differ from air supported fabric structures. Air-inflated structures typically consist of a plurality of self-enclosed or sealed membranes that are each inflated with air to form stiff structural members that form a frame that transmits applied loads to the points of support. In this way, the inflated structural members of air-inflated structures are utilized like studs and beams of traditional construction to support a roof or ceiling of the structure. Air-inflated structures thus do not include or form an internal air pressure within the enclosure itself to maintain an outer membrane in an elevated state or position as in air supported fabric structures. Air-inflated structures thereby do not encounter the same issues associated with providing hardware attachment points and raceways/conduits as in air supported fabric structures, as explained above.

As shown in FIG. 1, some air supported structures 10 are reinforced with a cable net 50. With cable-reinforced air-supported structures 10, the outer membrane 12 is enclosed in a cable net, as shown in FIG. 1. The outer membrane 12 distributes the load locally to the cables 50 which transfer the loads to base anchorage. It is noted that air supported structures 10 may or may not be cable reinforced.

Figure 2:
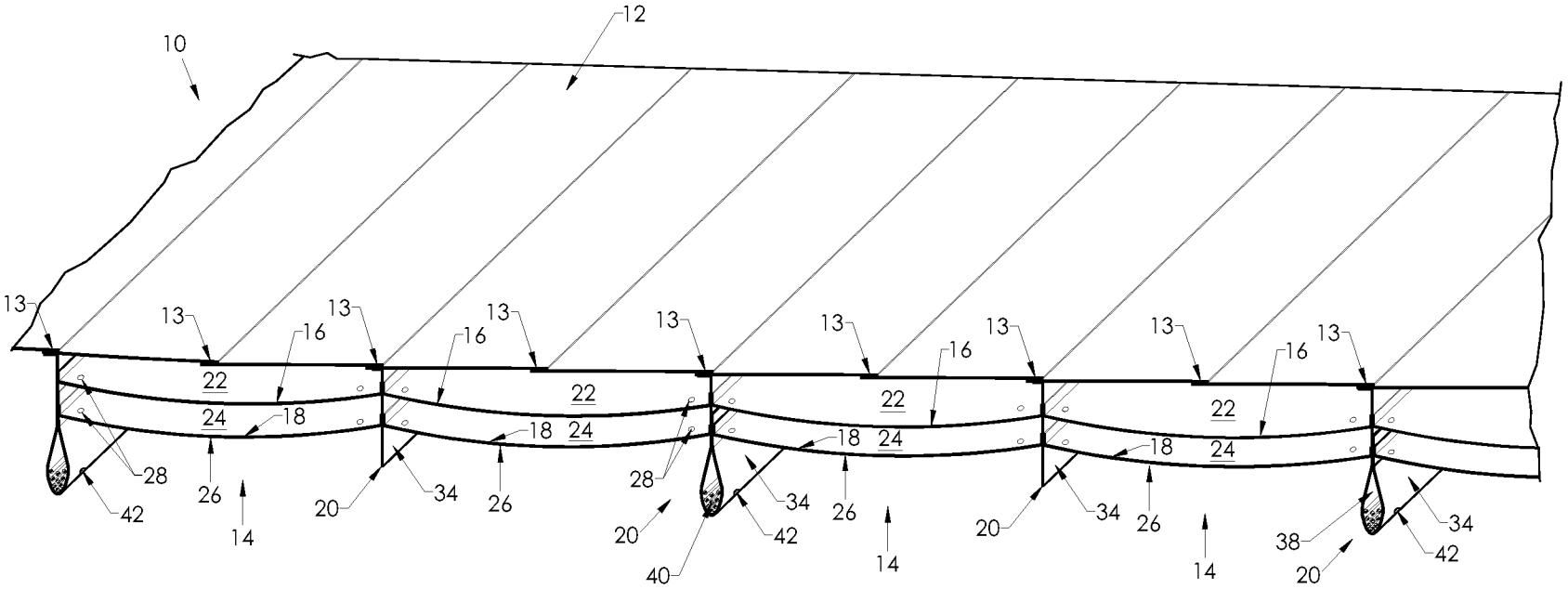
FIG. 2 is a perspective cutaway view of a portion of the fabric structure of FIG. 1.
Figure 7:
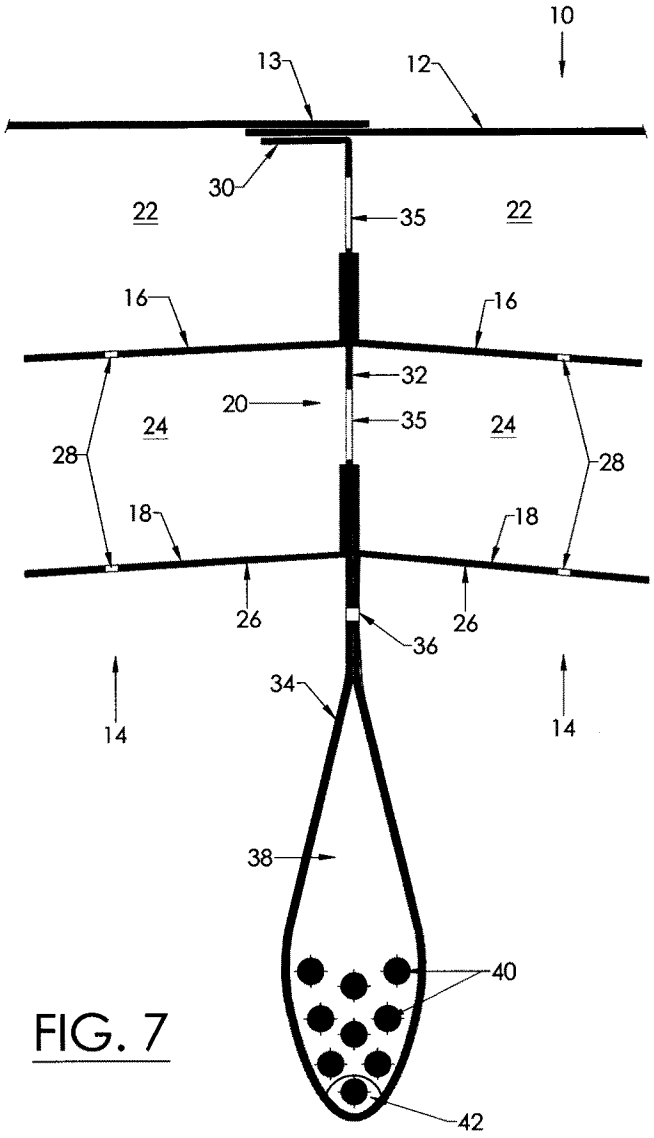
FIG. 7 is a cross-sectional view illustrating a tab member of the fabric structure of FIG. 1 with installed lighting hardware.

The outer membrane 12 may be formed from any sheet-like flexible, strong material. In some embodiments, the outer membrane 12 may be formed of a fabric, a rubberized fabric, a fabric coated with plastic, or any suitable combination thereof. For example, in one exemplary embodiment the outer membrane 12 may be made from polyester scrim, a bonding or adhesive agent, and a polyvinyl chloride (PVC) coating. In some embodiments, the outer membrane 12 may include a plurality of coatings. For example, in one exemplary embodiment the outer membrane 12 may include a PVC coating and at least one of an acrylic coating, a polyvinylidene fluoride or polyvinylidene difluoride (PVDF) coating, and/or an aramid fiber film (e.g., a Tedlar® film). The outer membrane 12 may be transparent, translucent or opaque. As shown in FIGS. 2 and 7, the outer membrane 12 may be formed of a plurality of panels, with adjacent panels being coupled to each other at a seam or joint 13. In some embodiments, adjacent panels of the outer membrane 12 may be partially overlapped, and at least a portion of such overlapping portions of the adjacent panels may be joined to each other to form a substantially airtight seam, seal or joint 13. For example, adjacent panels of the outer membrane 12 may partially overlap, and at least a portion of such overlapping portions of the adjacent panels may be heat sealed to each other to form a substantially airtight seal 13. However, the panels of the outer membrane 12 may be coupled to each in other ways, such as being sewn to each other. Joining of the panels that form the outer membrane 12 may be performed prior to erection of the structure 10, such as in a manufacturing facility where the seals 13 can be more easily and accurately performed and inspected. In some embodiments, heat sealing the panels forming the outer membrane 12 to each other may be accomplished by compressing and heating at least a portion of the overlapping portions to a temperature that is effective in melting and bonding the panels together. In addition to heat sealing adjacent panels of the outer membrane 12 together, the structure 10 may include one or more joint 13 that is clamped together. For example, relatively large portions of the outer membrane 12 may be formed by a plurality of panels being heat sealed together (such as in a manufacturing facility), and the relatively large portions of the outer membrane 12 may be clamped together (such as at the location of the structure 10 (i.e., "in the field")).

The panels forming the outer membrane 12 may be any size and shape, and may depend, at least in part, upon the desired size and shape of the fabric structure 10 formed thereby. For example, at least some of the panels forming the outer membrane 12 may be elongate such that the panels are longer along a width or lateral direction than a length or longitudinal direction. At least some other panels forming the outer membrane 12 may be elongate such that the panels are longer along the length or longitudinal direction than the width or lateral direction. Adjacent panels may be joined or sealed 13 along or proximate to the entirety of their respective adjacent and overlapped edges to form the substantially airtight outer membrane 12.

As shown in FIGS. 1-8, the fabric structure 10 may include a plurality of inner segments 14 including at least one inner liner panel extending between a pair of tab members 20 that extend from and are coupled to the main outer membrane 12. The structure 10 may include a plurality of the inner segments 14 positioned interior of the outer membrane 12 such that at least a substantial portion of the outer membrane 12 includes the inner segments 14. For example, in some embodiments the entirety of the outer membrane 12 may include inner segments 14. In this way, the envelope of the fabric structures 10 may be formed by the outer membrane 12 and the plurality of inner segments 14 coupled thereto. At least some of the segments 14 may extend along the entirety of a dimension of the fabric structure 10, as shown in FIG. 1. For example, the structure 10 may include inner segments 14 that extend along the entirety of the lateral width of the structure 10, as shown in FIG. 1. As also shown in FIG. 1, some of the segments 14 may extend along only a portion of a dimension of the structures, such as only partially along a longitudinal length of the structure 10.

Figure 8:
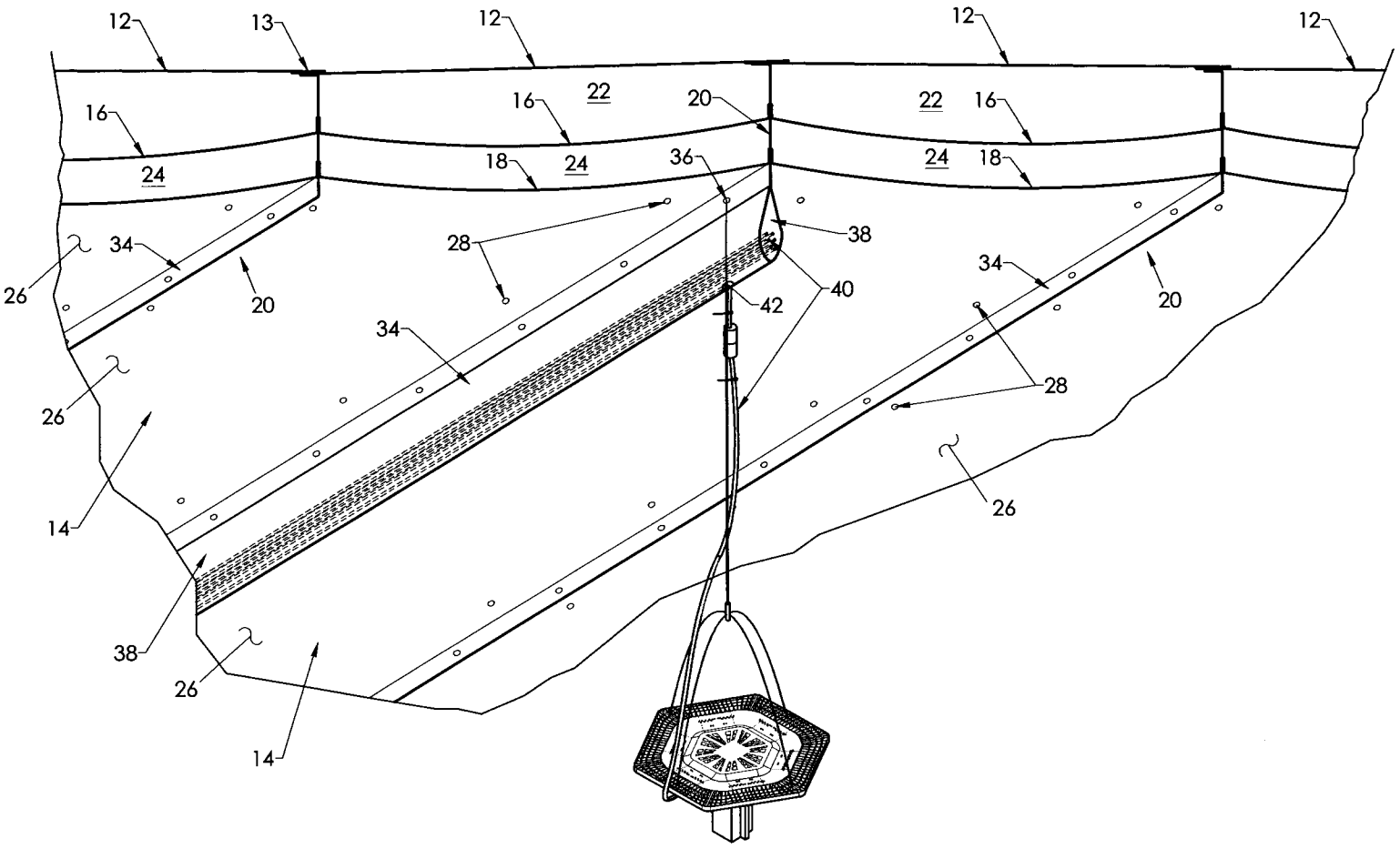
FIG. 8 is a perspective view illustrating a tab member of the fabric structure of FIG. 1 with installed lighting hardware.

As shown in FIGS. 2-8, in some embodiments the inner segments 14 of the fabric structure 10 may each include a first inner liner panel 16 and a second inner liner panel 18, as shown in FIGS. 2-8. However, the inner segments 14 may include only one inner liner panel, the first and second inner liner panels 16, 18, or three or more inner liner panels. Further, differing inner segments 14 may include a different quantity and/or arrangement of inner liner panels. As shown in FIGS. 2-8, the first inner liner panel 16 of one or more segments 14 of the fabric structure 10 may be positioned inwardly of the outer membrane 12 toward the interior of the enclosure (and generally towards the ground, particularly at the top portion of the enclosure). In this way, the first inner liner panel 16 and the outer membrane 12 may form a first air pocket or space 22 that extends between an interiorly-facing surface of the outer membrane 12 and an outwardly-facing surface of the first inner liner panel 16, as shown in FIGS. 2, 3, 7 and 8. Similarly, as shown in FIGS. 2-8, the second inner liner panel 18 of one or more segments 14 of the fabric structure 10 may be positioned inwardly of the first inner liner panel 16 toward the interior of the enclosure (and generally towards the ground, particularly at the top portion of the enclosure). In this way, the second inner liner panel 18 and the first inner liner panel 16 may form a second air pocket or space 24 that extends between an interiorly-facing surface of the first inner liner panel 16 and an outwardly-facing surface of the second inner liner panel 18, as shown in FIGS. 2, 3, 7 and 8. An inwardly facing-surface 26 of the second inner liner panel 18 (or the inner-most inner liner panel) may define an inner surface of the structure 10, which may define (in part) the enclosure, as shown in FIGS. 7 and 8. In this way, an inwardly facing-surface 26 of the second inner liner panel 18 (or the inner-most inner liner panel) may define at least a portion of the ceiling and/or side walls of enclosure.

As shown in FIGS. 2, 7 and 8, the first inner liner panel 16 and/or second inner liner panel 18 (and any other inner liner panel) of each inner segment 14 may include at least one through aperture 28 extending therethrough from the outwardly-facing surface to the interiorly-facing surface thereof. The first air pocket 22 of the inner segments 14 may thereby be in fluid or air communication with the second air pocket 24, and the second air pocket 24 of the inner segments 14 may thereby be in fluid or air communication with the enclosure of the structure 10. The at least one through aperture 28 of the second inner liner panel 18 may thereby allow air to flow therethrough from the enclosure to the second air pocket 24, and the at least one through aperture 28 of the first inner liner panel 16 may thereby allow air to flow therethrough from the second air pocket 24 to the first air pocket 22. The at least one through apertures 28 of the first and second inner liner panels 16, 18 of each inner segment 14 may thereby allow the first and second air pockets 22, 24 to form as the enclosure is erected, such as during inflation with air supported structures.

The at least one through aperture 28 of the inner liner panels 16, 18 may thereby allow air to flow therethrough from within the enclosure and to the interior or interiorly-facing surface of the outer membrane 12. In this way, if the structure 10 is an air supported structure, the air pressure created within the enclosure of the structure 10 via blowers or other mechanisms is able to extend through the inner liner panels 16, 18 and to the interior or interiorly-facing surface of the outer membrane 12 via the at least one through apertures 28 to exert an outwardly directed force or pressure thereon and form the enclosure (i.e., tension the outer membrane 12). Further, as the at least one through apertures 28 allow the pressure to equalize across the enclosure, the second air pocket 24 and the first air pocket 22, the first and second inner liner panels 16, 18 of each inner segment 14 are able to hang or suspend freely between the tab members 20 thereof, as shown in FIGS. 2 and 4-8.

The first inner liner panel 16 and/or second inner liner panel 18 may be similar to the panels forming the outer membrane 12. For example, the first inner liner panel 16 and/or second inner liner panel 18 may be made from the same or similar material as that of the outer membrane 12. In some embodiments, the inner liner panel 16 and/or second inner liner panel 18 may be formed from a relatively thinner and/or lighter fabric material than fabric forming the outer membrane 12.

As shown in FIGS. 2 and 7, at least some of the joints or seams 13 between the panels forming the outer membrane 12 of the structure 10 may be aligned with, or adjacent or proximate to, the side edges of the inner segments 14 of the fabric structure 10. In this way, the joints or seams 13 between the panels forming the outer membrane 12 may substantially align with the tab members 20, as shown in FIGS. 2 and 7. However, in some embodiments the structure 10 may include joints or seams 13 between the panels forming the outer membrane 12 that are offset or distal to the side edges of the inner segments 14 of the fabric structure 10 (and thereby offset or distal to the side edges of the first inner liner panel 16 and/or second inner liner panel 18 and the tab member 20), as shown in FIG. 2. In some embodiments, the structure 10 may include seams 13 of the outer membrane 12 that are positioned in medial portions of corresponding inner segments 14. In this way, as shown in FIG. 2, the structure 10 may include joints or seams 13 of the outer membrane 12 that are void of a tab member 20 and are positioned within an inner segment 14 (i.e., seams 13 that are not aligned with or proximate to tab member 20, but are positioned between a pair of tab members 20).

The tab members 20 may be substantially similar to the panels forming the outer membrane 12, the first inner liner panel 16 and/or second inner liner panel 18. For example, the tab members 20 may be made from the same or substantially similar materials as that of the outer membrane 12, the first inner liner panel 16 and/or second inner liner panel 18. The outer membrane 12, the first inner liner panel 16, the second inner liner panel 18 and the tab members 20 (or a combination thereof) may be configured such that they can be heat welded to each other, as explained further below. Each first inner liner panel 16, second inner liner panel 18 and/or tab member 20 may be a single unitary piece or component (i.e., may be of one-piece construction, monolithic or integral).

As shown in FIG. 7, one or more of the tab members 20 may extend from the interior or interiorly-facing surface of the outer membrane 12. For example, an end portion 30 of the tab member 20 may overlap a portion the outer membrane 12 along the interior surface thereof, as shown in FIG. 7. The end overlapped portion 30 of the tab member 20 may thereby extend substantially parallel to the corresponding overlapped portion of the outer membrane 12. At least a portion of the overlapping portions of the end portion 30 of the tab member 20 and the outer membrane 12 may be heat welded or sealed together. In such an embodiment, at least a portion of the overlapping portions of the end portion 30 of the tab member 20 and the outer membrane 12 may be heated and subsequently cooled such that the portions are bonded to each other. However, the end portion 30 of the tab members 20 may be affixed to the outer membrane 12 by means other than via heat sealing, such as being sowed, riveted, clamped or otherwise coupled (e.g., in addition to, or instead of, heat welding). As noted above, the tab members 20 may be coupled to the outer membrane 12 in a position distal to the seams 13 between adjacent panels (e.g., as shown in FIGS. 2 and 7), or may be coupled to the outer membrane 12 at or proximate to one or more seam 13 thereof. Further, the end portion 30 of the tab members 20 may be affixed to the outer/exterior or outwardly-facing surface of the outer membrane 12 rather than the interior surface as depicted in FIG. 7.

As also shown in FIG. 7, the tab members 20 may include a body portion 32 that extends from the end portion 30. The body portion 32 of the tab members 20 may extend away from an interior surface of the outer membrane 14 and the end portion 30 extends inwardly towards the interior of the enclosure and/or downwardly towards the ground (e.g., depending upon the particular position of a respective portion of the tab member 20). As noted above, the tab members 20 may also extend laterally along or across the width or longitudinally across or along the length (or a combination thereof) of the fabric structure 10, depending upon the orientation or design (e.g., shape) of the structure 10. In this way, the body portion 32 (and the end portion 30) of the tab members 20 may extend inwardly from the interior surface of the outer membrane 12 and laterally along or across the width or longitudinally across or along the length (or a combination thereof) of the fabric structure 10.

Figure 3:
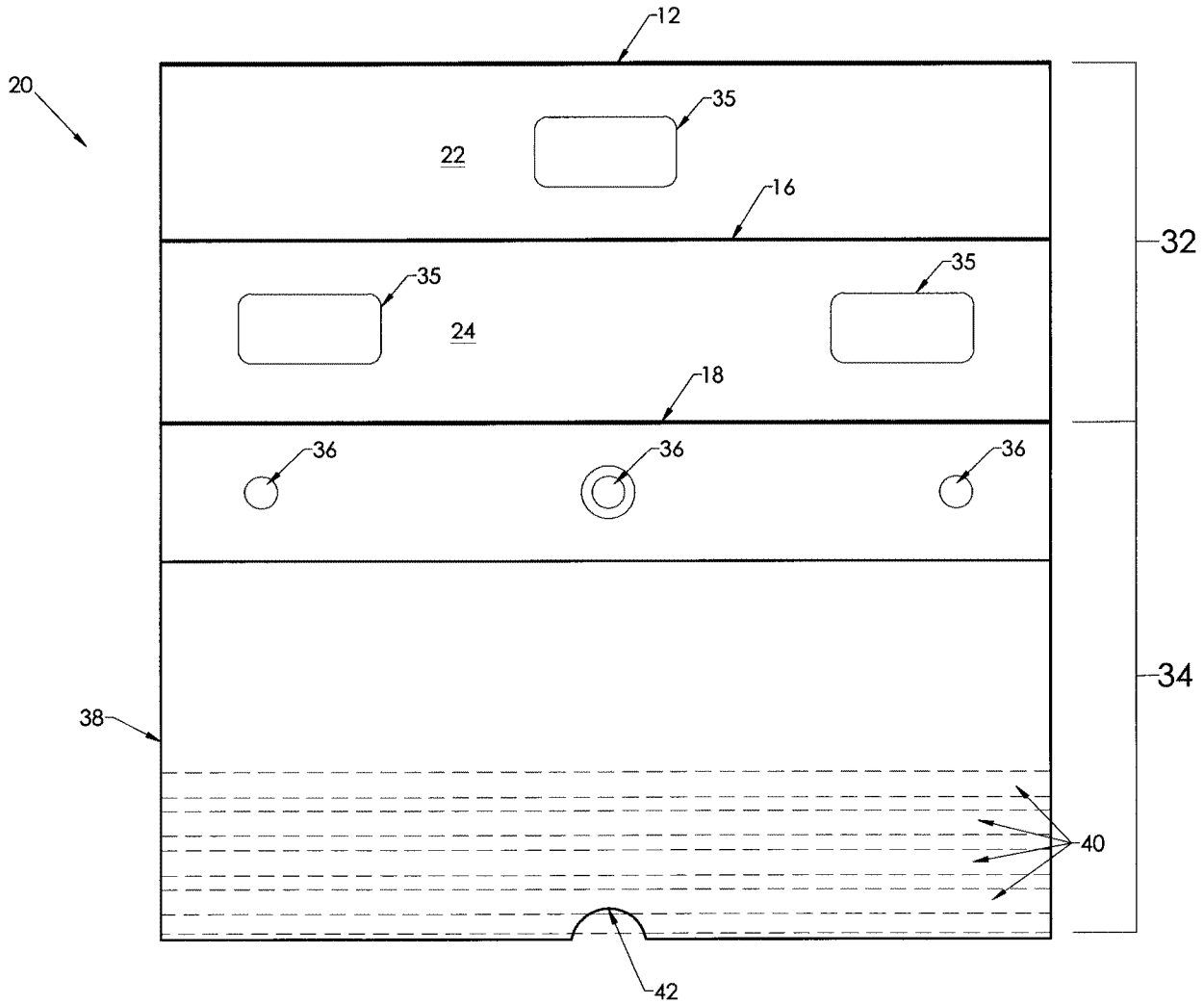
FIG. 3 is a side view illustrating a tab member of the fabric structure of FIG. 1.

With reference to FIG. 7, a first end portion of a first liner panel 16 of an inner segment 14 may overlap and be coupled to a first side or face of the body portion 32 of the tab member 20 of an inner segment 14. The overlapped portion of the first end portion of the first liner panel 16 may extend substantially parallel to the corresponding portion of the body portion 32 of tab member 20. The first end portion of the first liner panel 16 may be coupled to the first side of the body portion 32 of the tab member 20 such that the free or non-coupled portion of the first liner panel 16 that extends away from the tab member 20 to an adjacent tab member 20 (see FIG. 3) is inwardly spaced from the outer membrane 12. A second end portion of the first liner panel 16 of the inner segment 14 that opposes the first end portion thereof may be coupled to the adjacent tab member 20 in a substantially similar way as the first end portion, as shown in FIGS. 2 and 3, except that the opposing second end portion of the first liner panel 16 is coupled to a second side or face of the adjacent tab member 20 that substantially opposes the first face thereof. In this way, the position of the coupling between the first and second end portion of the first liner panel 16 to the first and second faces of the body portion 32 of the adjacent tab members 20, respectively, may define the shape and/or thickness of the first air pocket 22 in a direction extending from the outer member 20 toward the interior of the enclosure. In some embodiments, the portions of the first and second end portions of the first liner panel 16 that overlap and are coupled to the first and second sides of the tab members 20, respectively, may extend from adjacent or proximate to the outer membrane 12 to a respective interior portion of the tab member 20.

As also shown FIG. 7, the body portion 32 of the tab members 20 may extend past the first inner liner members 16 coupled thereto further towards the interior of the enclosure. A first end portion of a second inner liner panel 18 may thereby overlap and be coupled to the first face of the body portion 32 of the tab member 20 below or inwardly of an adjacent first inner liner member 16, as shown in FIGS. 2 and 7. The overlapped portion of the first end portion of the second inner liner panel 18 may extend substantially parallel to the corresponding portion of the body portion 32 of tab member 20. The first end portion of the second liner panel 18 may be coupled to the first side of the body portion 32 of the tab member 20 such that the free or non-coupled portion of the second inner liner panel 18 that extends away from the tab member 20 to an adjacent tab member 20 (see FIG. 3) is inwardly spaced from the first liner panel 16. A second end portion of the second liner panel 18 of the inner segment 14 that opposes the first end portion thereof may be coupled to the adjacent tab member 20 in a substantially similar way as the first end portion, as shown in FIGS. 2 and 3, except that the opposing second end portion of the second inner liner panel 18 is coupled to the second face of the adjacent tab member 20. In this way, the position of the coupling between the first and second end portions of the second inner liner panel 18 to the first and second faces of the body portion 32 of the tab members 20, respectively, of an inner segment 14 may define the shape and/or thickness of the second pocket 24 in a direction extending from the first liner panel 16 toward the interior of the enclosure. In some embodiments, the portions of the first and second end portions of the second inner liner panel 18 that overlap and are coupled to the first and second sides of the tab members 20, respectively, may be spaced inwardly from the first liner panel 16.

The overlapped and coupled portions of the first and/or second end portions of the first liner panels 16 and their respective tab members 20, and/or the overlapped and coupled portions of the first and/or second end portions of the second inner liner panels 18 and their respective tab members 20, may be heat welded or sealed together. In such an embodiment, at least a portion of the overlapping portions may be heated and subsequently cooled such that the portions are bonded to each other. However, the portions may be coupled or affixed to each other via any other process, such as being sowed, riveted, clamped or otherwise coupled together (e.g., in addition to, or instead of, heat welding). The tab members 20 and the outer membrane 20 may be coupled together prior to the structure 10 being erected (e.g., prior to installation and production of the internal pressure that forms the enclosure). Similarly, the tab members 20 and the first and/or second inner liner panels 16, 18 may be coupled together prior to the structure 10 being erected (e.g., prior to installation and production of the internal pressure that forms the enclosure). As such, the tab members 20 and the outer membrane 20, and/or the tab members 20 and the first and/or second inner liner panels 16, 18, may be coupled together in a manufacturing facility where the integrity of the coupling mechanism(s) (e.g., heat welds or seals) can be controlled and inspected.

As shown in FIGS. 3 and 7, the body portion 32 of one or more of the tab members 20 may include at least one through aperture 35 extending therethrough that couples adjacent inner segments 14 in fluid or air communication. In some embodiments, a plurality of consecutive segments 14 (such as segments 14 of the same orientation) may be in air communication via the at least one through aperture 35 of the body portion 32 of the tab members 20. The at least one through aperture 35 of the body portion 32 of the tab members 20 may extend through the body portion 32 from the first face to the second face thereof. The at least one through aperture 35 of the body portion 32 may also extend through the portions of the first and/or second inner liner panels 16, 18 coupled thereto. The at least one through aperture 35 of the body portion the portion 32 may be configured to allow air to flow between adjacent first air pockets 22 and/or second air pockets 24 of adjacent inner segments 14, as shown in FIGS. 3 and 7. For example, a tab member 20 may include a first through aperture 35 that extends through the body portion 32 (and potentially portions of first inner liners 16 overlapped and coupled thereto) between a pair of adjacent first air pockets 22 to allow air to flow therebetween. Similarly, a tab member 20 may include a second through aperture 35 that extends through the body portion 32 (and potentially portions of second inner liners 18 (and/or first inner liners 16) overlapped and coupled thereto) between a pair of adjacent second air pockets 24 to allow air to flow therebetween. In some embodiments, one or more of the tab members 20 may include a plurality of through apertures 35 spaced along the length thereof (e.g., extending along a lateral and/or longitudinal dimension of the structure 10) that extend through the body portion 32 thereof (and potentially first and/or second inner liners 16, 18 coupled thereto) to couple adjacent inner segments 14 (e.g., couple first pockets 22 and/or second pockets 24) in air communication along their lengths. The at least one through aperture 35 may allow air to flow between adjacent inner segments 14, such as between first pockets 22 and/or second pockets 24 thereof, to aid or facilitate air flow between the inner segments 14 (such as between first pockets 22 and/or second pockets 24 thereof) during heating and/or cooling of the outer member 12, for example. As another example, the at least one through aperture 35 may allow air to flow between adjacent inner segments 14, such as between first pockets 22 and/or second pockets 24 thereof, to aid or facilitate air flow between the inner segments 14 (such as between first pockets 22 and/or second pockets 24 thereof) during erection and/or take down of the structure 10.

Figure 4:
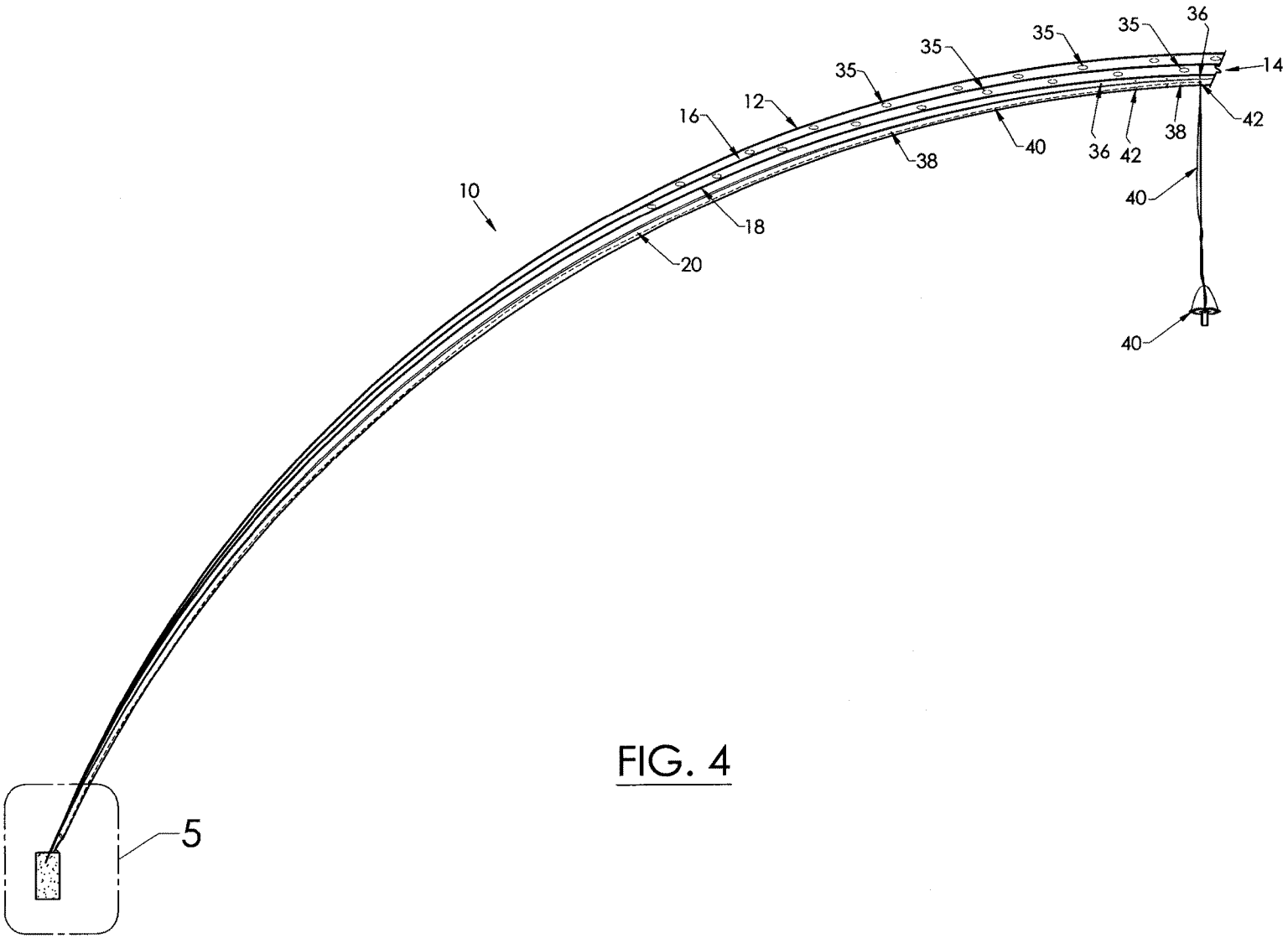
FIG. 4 is a cross-sectional view of a portion of the fabric structure of FIG. 1.
Figure 6:
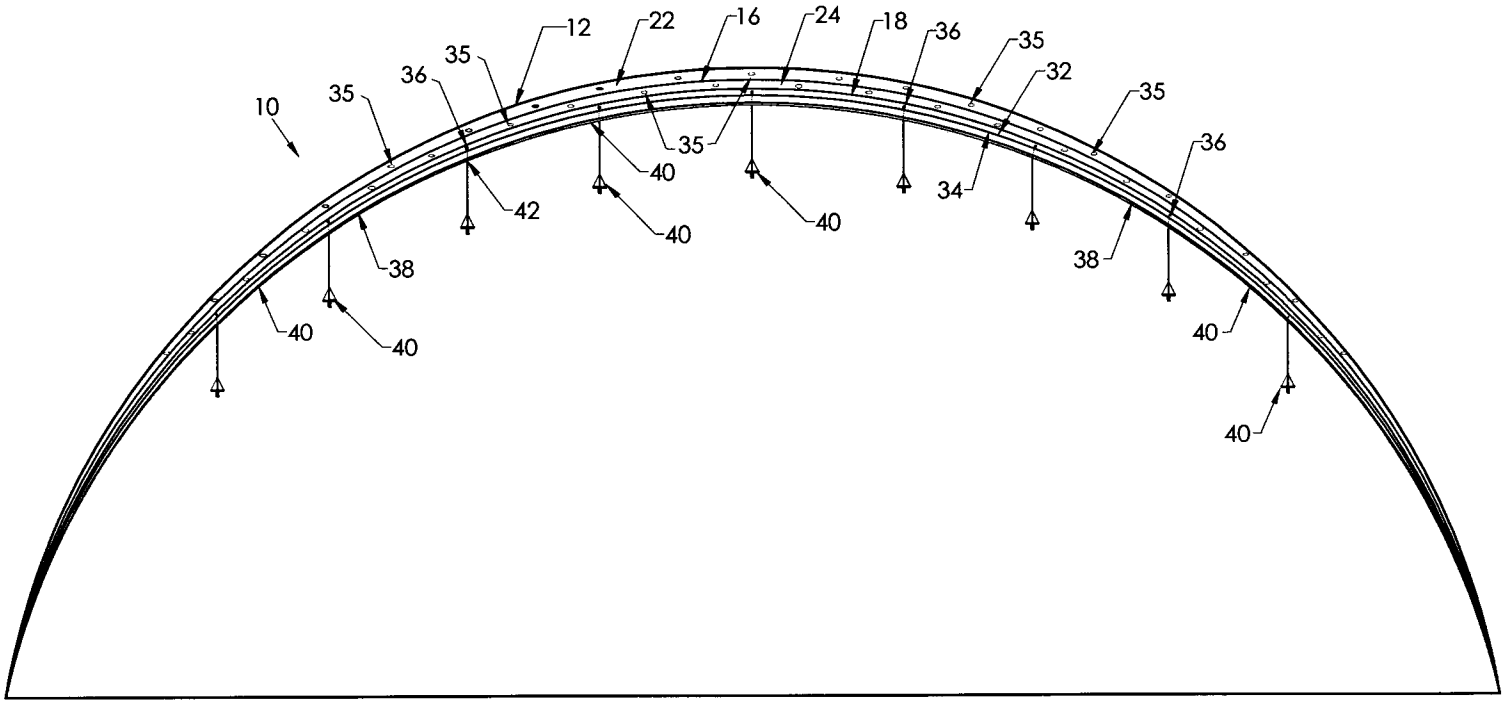
FIG. 6 is a cross-sectional view of a portion of the fabric structure of FIG. 1 with lighting hardware installed.

As shown in FIG. 6, the body portion 32 of the tab members 20 may extend along the entirety of the length of the tab members 20. In other embodiments, however, the body portion 32 of the tab members 20 may extend along only a portion of the length of the tab members 20. As noted above, the tab members 20, and thereby, the body portion 32 thereof, may extend along a dimension (e.g., lateral width or longitudinal length) of the structure 10, such as across at least a portion of the width and/or length of the structure 10. In some embodiments, as shown in FIGS. 4-6, the thickness or length of at least the body portion 32 of at least some of the tab members 20 measured inwardly from the inner surface of the inner-most inner liner panel 18 toward the interior of the enclosure may differ in differing portions of the tab members 20 (and thereby, in differing portions of the structure 10). In this way, the spacing between the first liners 16 and the outer membrane 12 (i.e., the thickness of the first air pockets 22) and/or the spacing between the first inner liner panels 16 and the second inner liner panels 18 (i.e., the thickness of the second air pockets 24) may vary depending upon their positon or location, as shown in FIGS. 4-6. For example, at least the body portion 32 of at least some of the tab members 20 may be shorter or thinner proximate to the ground and/or support structure that supports structure 10 as compared to a medial portion of the tab members 20 or portions distal to the ground and/or support structure, as shown in FIGS. 4-6. In this way, the thickness of the first air pockets 22 and/or second air pockets 24 may vary depending upon their positon or location. As shown in FIG. 6, in some embodiments the apex or central portion of tab members 20 that extend across the width of a structure 10 may include the largest body portion 32 (and thereby the thickest first air pockets 22 and/or second air pockets 24).

At least one tab member 20 of the structure 10 may include an attachment portion 34 extending from the body portion 32, as shown in FIGS. 2, 3, 7 and 8. The attachment portion 34 of the tab member 20 may thereby extend past the interior surface 26 of the second liner panel 18 (or the inner-most panel) and into the enclosure. The attachment portion 34 may thereby be positioned proximate to the interior surface 26 of the second inner liner panel 18 or the inner-most lner panel (i.e., the interior walls or surfaces defining the enclosure). The attachment portion 34 may extend inwardly toward the interior of the enclosure from the body portion 32 of the tab member 20, as shown in FIG. 7. The attachment portion 34 of the tab members 20 may thereby extend past the interior surfaces of the inner-most inner liner panel 18 towards the interior of the enclosure and/or downwardly towards the ground.

The attachment portion 34 of the tab member 20, which is positioned within the enclosure proximate to the interior surface of the second liner panel 18 or the inner-most panel, may include or define at least one hardware attachment point, such as at least one aperture 36 as shown in FIGS. 3 and 7. The at least one aperture of the attachment portion 34 of the tab member 20 may provide at least integrated and secure hardware attachment point proximate to the interior surface 26 of the inner-most inner panels 18. For example, the at least one aperture 36 of the attachment portion 34 of the tab members 20 may be configured to allow hardware to pass therethrough and, thereby, be supported by the tab members 20. In some embodiments, the attachment portion 34 of the tab members 20 may include a plurality of apertures 36 that are spaced along the length of the tab members 20 (and thereby along the length of the inner segments 14). For example, the attachment portion 34 of the tab members 20 may include a plurality of apertures 36 that are spaced along a lateral or longitudinal dimension of the structure 10, depending upon the configuration and/or orientation of the inner segments 14. In some embodiments, the attachment portion 34 of the tab members 20 may include a plurality of apertures 36 that spaced are regular or even intervals the length of the tab members 20. In some embodiments, the attachment portion 34 of the tab members 20 (and/or the body portion 32 thereof) may be a netting or other substantially open configuration that forms a plurality of apertures 36.

The at least one aperture 36 of the attachment portion 34 of the tab members 20 may be utilized as at least one hardware attachment mechanism or hanging point for any hardware that may be utilized with the structure 10. As the at least one aperture 36 of the tab members 20 is positioned within the enclosure of the structure 10, the at least one aperture 36 can be utilized to attach hardware of any type or purpose proximate to the interior surface 26 of the enclosure. For example, the at least one aperture 36 of the tab members 20 may be utilized to attach or hang curtains, nets, signs, fans, speakers, cameras, sensors (e.g., air quality sensors), communication (internet), audio and/or visual or fixtures, other electrical fixtures, plumbing fixtures, wiring (e.g., electrical wiring), tubing or piping, clips, or any other desirable hardware, mechanisms or members from the structure 10 proximate to the interior surface 26 of the enclosure. Similarly, although the although attachment portion 34 of the tab members 20 may include at least one aperture 36 as the attachment point, any other mechanism or configuration may be utilized to attach hardware to the attachment portion 34 positioned within the enclosure (e.g., proximate to the outer membrane 12). For example, the at least one attachment point of the attachment portion 34 positioned within the enclosure may comprise at least one hook, loop, clip, tying or tyable members, hook and/or loop members, snap or any other mechanism that is formed by, or attached or coupled to, the attachment portion 34 positioned within the enclosure that is configured to, or capable of, attaching at least one hardware member to the tab member 20 within the enclosure.

The attachment portion 34 of the tab members 20 may define the at least one aperture 36 such that the at least one aperture 36 extends through the tab members 20 from the first face to the second face. In this way, the at least one aperture may extend through the sheet-like tab members 20. The at least one aperture 36 may be any size and shape, and may be positioned anywhere on the attachment portion 34. In some embodiments, as shown in FIGS. 3 and 7, the attachment portion 34 may be folded over or overlapped upon itself at least once and coupled together (e.g., via heat sealing), and the at least one aperture 36 may extend through the coupled overlapped portions of the at least one aperture 36. As such, as shown in FIGS. 3 and 7, the multiple layers of the tab member 20 material about the at least one aperture 36 may provide for a secure attachment point that is resistive to tearing out or through the tab member 20. As shown in FIG. 3, at least one aperture 36 may include a grommet or other supportive mechanism that further strengthens the at least one aperture 36 to enhance the stability and/or strength of the attachment point. The grommet or other supportive mechanism of the at least one aperture 36 may also aid in coupling hardware to the at least one aperture 36.

As shown in FIGS. 2-8, in some embodiments the attachment portion 34 of the tab members 20 may form or include at least one conduit portion 38 defining a cavity through which hardware 40 (e.g., wire, piping, elongate attachment members, etc.) may extend or be carried within. The at least one conduit portion 38 may thereby serve as at least one hardware attachment mechanism or point. The at least one conduit portion 38 of the tab members 20 may differ from the at least one aperture 36 in that the at least one aperture 36 may extend through the tab member 20 between opposing faces thereof along a thickness direction, while the at least one conduit portion 38 may extend, at least partially, along the length of the tab members 20 (e.g., extending along a lateral and/or longitudinal dimension of the structure 10). In some embodiments, at least one of the tab members 20 of the structure 10 may include both the at least one conduit portion 38 and the at least one aperture 36 to provide differing hardware attachment mechanisms or points (which may be better suited for differing types of hardware 40 or applications).

It is noted that at least some of the tab members 20 (or all of the tab members 20) of the structure 10 may not include or form the at least one conduit portion 38, as shown in FIG. 2. Stated differently, as shown in FIG. 2, the attachment portion 34 of at least some of the tab members 20 (or all of the tab members 20) of the structure 10 may not include or form the at least one conduit portion 38. For example, at least some of the tab members 20 may include an attachment portion 34 that extends from the body portion 32 thereof and terminates at a free end, as shown in FIG. 2. The attachment portion 34 of such tab members 20 may include the at least one aperture 36 to serve as at least one hardware attachment point or mechanism, but may be void of the at least one conduit portion 38. The attachment portion 34 of such tab members 20 may thereby not include an aperture or conduit that extends along the length of the tab members 20 (and thereby potentially only include the at least one aperture 36 that extends through the attachment portion 34). In this way, the thickness or length of portions of the attachment portion 34 of tab members 20 that are void of the at least one conduit portion 38 measured inwardly from the inner surface of the inner-most inner panel 18 toward the interior of the enclosure may be shorter than corresponding portions of the attachment portion 34 of tab members 20 that include or form the at least one conduit portion 38, as shown in FIG. 2.

The at least one conduit portion 38 may be an elongated raceway, conduit, channel, tube, cavity, passage or aperture that extends along the length of the tab member 20, as shown in FIGS. 2-8. The conduit portion 38 may be substantially enclosed such that hardware 40 carried or positioned therein is surrounded by the conduit portion 38 in cross-section, as shown in FIG. 7. The at least conduit portion 38 may thereby hide or at least obscure hardware 40 positioned therein viewed from within the enclosure. Further, the at least conduit portion 38 may also gather, bundle or group together a plurality of hardware 40 positioned therein, as shown in FIG. 7.

Figure 9:
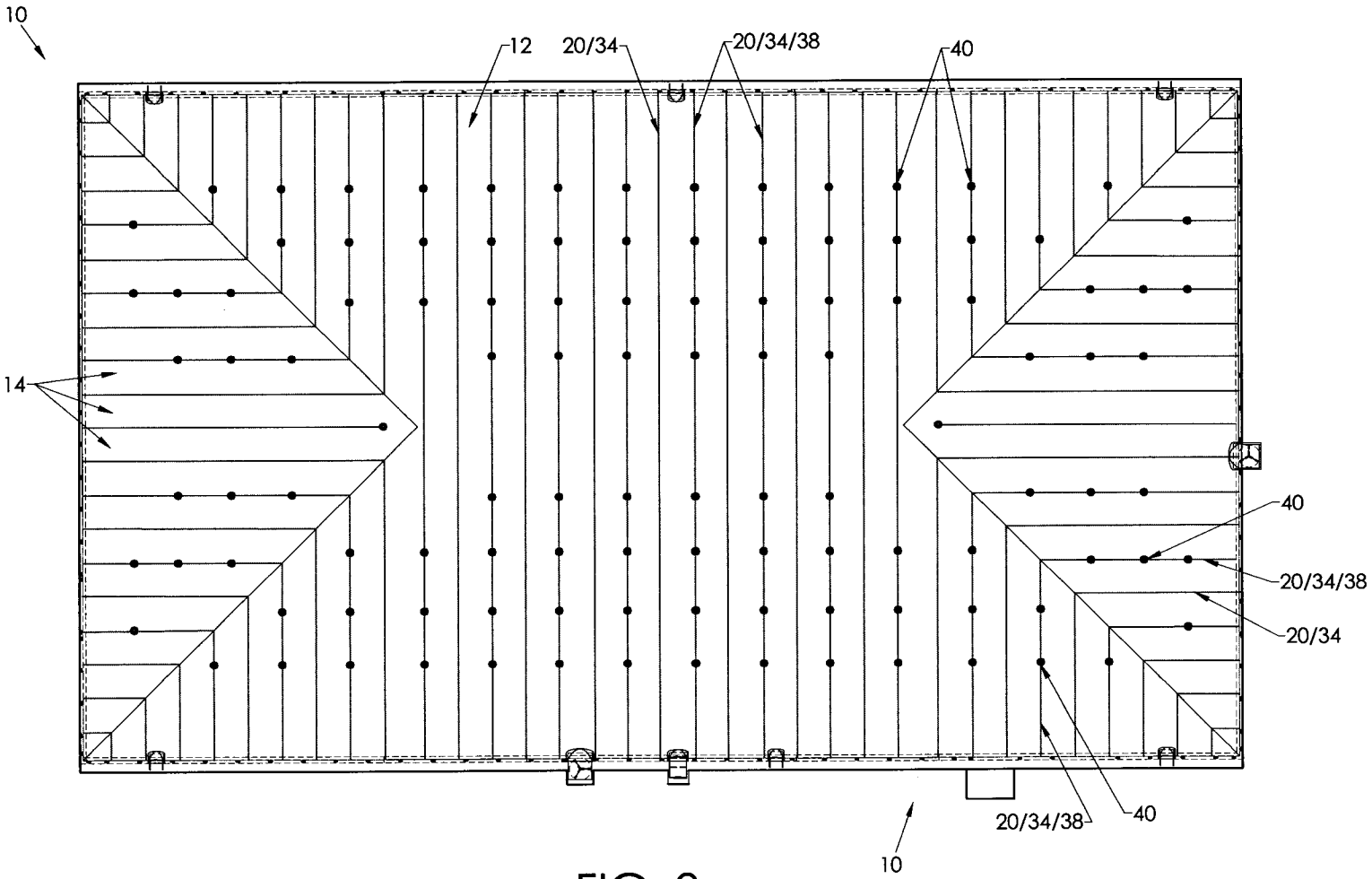
FIG. 9 is a top view of the fabric structure of FIG. 1 with lighting installed illustrating a layout of the hardware.

As shown in FIGS. 6 and 9, at least some of the tab members 20 may include a conduit portion 38 that extends along the entirety of the length of the tab members 20 (which may extend along the entirety of the length of the inner segments 14 and/or a dimension (e.g., lateral width or longitudinal length) of the structure 10. In other embodiments, at least one of the tab members 20 of the structure 10 may include one or more conduit portions 38 that extend along only a portion of the length of the tab members 20 (not shown). In some such embodiments, at least one of the tab members 20 may include a plurality of conduit portions 38 that each extend along a portion of the length of the tab members 20. The plurality of conduit portions 38 may be positioned adjacent to each other, may be spaced from each other along the length of the respective tab member 20, or a combination thereof.

As shown in FIGS. 2 and 7, in some embodiments the conduit portion 38 of the attachment portion 34 of at least one tab member 20 may be formed by the attachment portion 34 being bent or folded over upon itself and a portion of the overlapped portions coupled to each other (e.g., heat welded). For example, as shown in FIG. 7, a free end portion of the attachment portion 34 of a tab member 20 may be overlapped and coupled with a portion of one of the faces of the attachment portion 34 proximate to the interior surface 26 of a second liner 18 (or the inner most-liner) coupled to the tab member 20. The non-coupled overlapping portions of the attachment portion 34 of the tab member 20 may thereby form the conduit portion 38 (as a conduit or similar structure), as shown in FIGS. 2, 7 and 8. In this way, in some embodiments the conduit portion 38 may take on or form a teardrop shape. While the illustrated exemplary embodiments the tab members 20 include a portion of the attachment portion 34 extending between the innermost liner panel (e.g., the first and/or second inner liner panels 16, 18) and the conduit portion 38 that includes at least one attachment point (such as at least one aperture 36, hook, clip, tying members, hook and/or loop members, etc.), other embodiments may include the conduit portion 38 positioned between the innermost liner panel (e.g., the first and/or second inner liner panels 16, 18) and the portion of the attachment portion 34 that includes at least one attachment point.

The free end portion of the attachment portion 34 of a tab member 20 may be the end portion of the tab member 20 itself. In this way, in some embodiments a tab member 20 may extend from the outer membrane 12 (e.g., from the interior surface thereof), past the inner liner members 16, 18, and back upon itself proximate to the inner most liner 16, 18 to form the attachment portion 34 (i.e., the conduit portion 38). The bottom or end of the conduit portion 38 of the attachment portion 34 may define a free end of the tab member 20 and may be the portion of the tab member 20 that is positioned furthest distal from the outer membrane 12 and/or the inner most panel (e.g., the second inner panel 18), as shown in FIGS. 2 and 8.

Overlapped portions of the attachment portion 34 of a tab member 20 may be coupled to each other via any process or mechanism. For example, the overlapped portions of the attachment portion 34 may be heat welded, sowed, riveted, clamped, selaed or otherwise coupled together. In some embodiments, the overlapped portions of the attachment portion 34 may be coupled to each other via heat welding or sealing. As explained above, the tab members 20 may be integrated into the structure 10 before the structure 10 is erected, and therefore such heat sealing (or other coupling procedure(s)) of portions of the attachment portion 34 to form the conduit portion 38 may be accomplished in a manufacturing facility with equipment that ensures the integrity of the welds or seals.

As shown in FIGS. 3, 4 and 6-8, the at least one conduit portion 38 of one or more tab members 20 of the structure 10 may include at least one aperture 42 extending therethrough. The at least one aperture 42 may thereby extend from the enclosure into the interior of the conduit portion 38. The at least one aperture 42 of at least one conduit portion 38 of the tab members 20 may be any size, shape and position. In some embodiments, a conduit portion 38 may include a plurality of apertures 42 along its length, as shown in FIGS. 4 and 6. For example, a conduit portion 38 that extends along the entirety of the length of an inner segment 14 (that may or may not extend along the entirety of a dimension of the structure 10), as shown in FIGS. 4 and 6, may include a plurality of apertures 42 that are spaced (e.g., at equal intervals) along the length of the conduit portion 38. In some embodiments, a conduit portion 38 may include a plurality of apertures 42 that are centered or positioned substantially overhead in the enclosure.

The at least one aperture 42 may be in communication with the at least one conduit portion 38 such that elongate hardware 40 housed within the conduit portion 38 can extend into the enclosure via the at least one aperture 42, as shown in FIGS. 4, 6 and 8. As also shown in as shown in FIGS. 4, 6 and 8, additional hardware 40, such as lighting or plumbing fixtures, may be coupled to the portion of the hardware 40 that extends into the enclosure from the conduit portion 38 via a respective aperture 42. In this way, the conduit portion 38 may serve to bundle and conceal hardware 40 and provide an attachment or hanging point for the hardware 40 from within the enclosure of the structure 10. As shown in FIG. 8, the at least one aperture 42 of the conduit portion 38 may allow or wiring other mechanisms to extend to the hardware 40 located within the enclosure from within the conduit portion 38, and the hardware 40 itself can be at least partially, primarily or fully physically supported by the at least one fixation aperture 36 of the attachment portion 34 of the tab member 20. In this way, for example, the attachment portion 34 of the tab member 20 may provide at least the primary physical support for a particular hardware mechanism 40, while the conduit portion 38 may house and support additional hardware (e.g., wiring, plumbing, etc.) that couples or extends to the particular hardware mechanism 40. In some embodiments, the conduit portion 38 may house non-elongate hardware (e.g., in addition to elongate hardware), such as electrical boxes, control panels, valves, transformers or any other non-elongate hardware that may be utilized with the structure 10. In some embodiments, the at least one aperture 42 of the conduit portion 38 of the at least one tab member 20 may substantially align with the at least one fixation aperture 36 of the attachment portion 34 of the at least one tab member 20 along the length of the at least one tab member 20 so that substantially aligned apertures 42, 36 can be utilized to support and/or operate a hardware mechanism 40.

In some embodiments, the at least one conduit portion 38 and the at least one aperture 42 may also be utilized to provide a hanging or fixation point for hardware 40 that does not extend or is coupled to hardware 40 that is carried within the at least one conduit portion 38. For example, a support member, such as a relatively stiff and strong elongate support member or rod, may be positioned within the at least one conduit portion 38 such that is extends past the at least one aperture 42 (not shown). The portion of the support member exposed via the aperture 42 may be utilized to hang hardware 40 to or from the structure 10 via the tab member 20. As another example, a clip or other mechanism may be configured to extend into the conduit portion 38 via the at least one aperture 42 to hang or secure hardware 40 from the structure 10 or provide a connection point to which hardware 40 could be hung, if need be.

As shown in FIG. 9, the structure 10 may be configured such that a network or pattern of conduit portions 34 of inner segments 14 is provided within a substantial portion of the enclosure. As shown in FIG. 9, a plurality of inner segments 14 may be provided in a medial portion of the longitudinal length of the structure 10 that extend across the entirety of the lateral width of the enclosure. The conduit portions 34 thereof may thereby also extend across the entirety of the lateral width of the enclosure, and a plurality of apertures 42 may be provided along the length thereof. Hardware 40 can thus extend across the entire, or alternatively partial, width of the enclosure within the conduit portions 34, and extend into the interior of the enclosure via the apertures 42, shown in FIG. 9. As also shown in FIG. 9, a plurality of inner segments 14 may be provided at longitudinal ends of the structure 10 that extend along a portion of the, or alternatively the entire, longitudinal length of the enclosure. The conduit portions 34 thereof may thereby also extend along a portion of the longitudinal length of the enclosure, and a plurality of apertures 42 may be provided along the length thereof. Hardware 40 can thus extend along a portion of the longitudinal length of the enclosure within the conduit portions 34, and extend into the interior of the enclosure via the apertures 42, shown in FIG. 9. The laterally and longitudinally extending conduit portions 34 and spaced plurality of apertures 42 may thereby form a network to provide a substantial portion of the structure 10 with hardware conduits and attachment points. It is noted, however, that a structure 10 may be configured or arranged differently than shown in FIG. 9 with any configuration or arrangement of conduit portions 34 and apertures 42.

Figure 10:
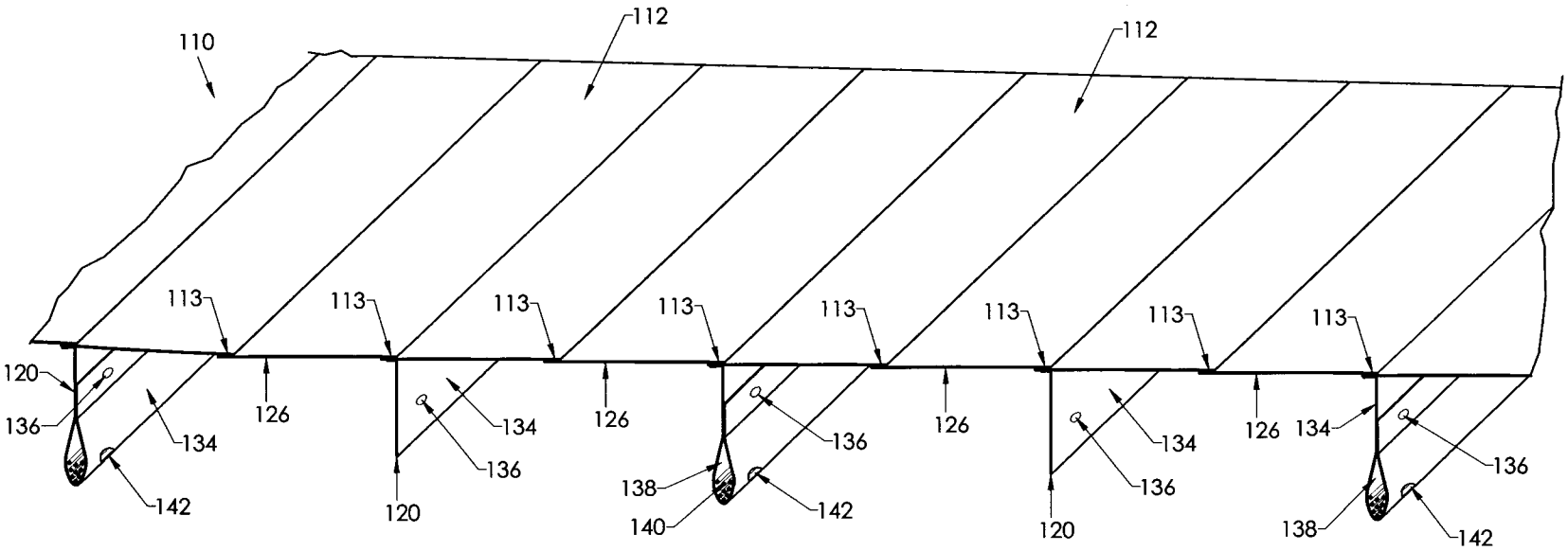
FIG. 10 is a perspective cutaway view of a portion of another fabric structure according to the present disclosure.

FIG. 10 illustrates a portion of another fabric structure according to present disclosure that is generally indicated by reference numeral 110. The structure 110 of FIG. 10 is substantially similar to the structure 10 of FIGS. 1-9, and therefore like reference numerals preceded by the numeral "1" are used to indicate like elements, functions, aspects or the like (and therefore the corresponding description thereof, including alternative embodiments, presented above with respect to structure 10 of FIGS. 1-9 may equally apply to structure 110 of FIG. 10 except as noted below). As shown in FIG. 10, structure 110 differs from structure 10 of FIGS. 1-9 in that an inner liner is not provided. In this way, the outer membrane 112 forms the exterior surface and the interior or inwardly facing-surface 126 of the enclosure. The interior surface 126 of the outer membrane 112 may thereby define or form at least a portion of the ceiling and/or side walls of enclosure.

As shown in FIG. 10, the tab members 120 may extend directly from the interior surface of the outer membrane 120 toward the interior of the enclosure. As described above, the tab members 120 may be coupled or sealed to the interior surface (and/or exterior surface) of the outer membrane 120. As also shown in FIG. 10, the attachment portion 134 of at least some of the tab members 120 may define or form the at least one conduit portion 138. At least some of the tab members 120 may thereby form at least one elongate conduit 138 configured to house hardware 140 therein via at least one conduit portion 138, as described above. As also described above, the attachment portion 134 of at least some of the tab members 120 may be void of the at least one conduit portion 138.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present disclosure have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the present disclosure.

The invention claimed is:

1. An air supported structure forming an enclosure with internal pressurized air, comprising:

an outer membrane coupled to a base and extending from the base to an elevated position via the internal pressurized air, the outer membrane defining an outer surface of the structure;

a plurality of inner segments formed of tab members fixedly coupled to and extending from the outer membrane toward the interior of the enclosure, and at least one inner liner panel coupled to and extending between adjacent tab members spaced inwardly from the outer membrane to form at least one air pocket, therebetween; and a plurality of hardware coupled to the tab members and extending downwardly therefrom into the interior of the enclosure, wherein the tab members are formed of a flexible fabric material, wherein an attachment portion of each of the tab members extends inwardly past the at least one inner liner panel into the enclosure, wherein the attachment portion of each of the tab members comprises a conduit portion that defines an elongate raceway, a plurality of spaced first apertures in the conduit portion that form passageways extending from the raceway to the enclosure, a hardware support portion extending between the conduit portion and the at least one inner liner panel, and a plurality of spaced second apertures extending through the hardware support portion positioned proximate to the plurality of spaced first apertures and spaced from the conduit portion, wherein the structure defines a lateral width and a longitudinal length, and the inner segments extend at least along the lateral width of the structure such that the attachment portions of the tab members extend from a first lateral side of the structure proximate to a first lateral side of the base to a second lateral side of the structure proximate to a second lateral side of the base, and wherein each hardware extends through the raceway of the conduit portion of one of the tab members, extends through one of the first apertures of the conduit portion, and is coupled to one of the second apertures of the hardware support portion to physically support the hardware.

2. The air supported structure of claim 1, wherein the plurality of first and second apertures are spaced along the lateral width of the structure.

3. The air supported structure of claim 1, wherein a first portion of the attachment portion of the tab members is bent over and coupled to a second portion of the attachment portion proximate to the at least one inner liner panel to form the conduit portion thereof.

4. The air supported structure of claim 1, wherein the conduit portion defines a free end portion of the tab members.

5. The air supported structure of claim 3, wherein the first and second portions of the attachment portion are heat welded together.

6. The air supported structure of claim 1, wherein the tab members include at least one third aperture extending therethrough that allows air to flow between adjacent first air pockets.

7. The air supported structure of claim 1, wherein the tab members are coupled to and extend from an inwardly-facing surface of the outer membrane.

8. The air supported structure of claim 1, wherein the inner segments are each formed of a pair of tab members and at least one inner liner panel extending therebetween, and wherein adjacent inner segments share a common tab member.

9. The air supported structure of claim 8, wherein the at least one inner liner panel of each inner segment is coupled to and extends between a first face of a first tab member and a second face of a second tab member.

10. The air supported structure of claim 1, wherein the inner segments comprise a first inner liner panel coupled to and extending between opposing side faces of adjacent tab members spaced inwardly from the outer membrane forming a first air pocket between the outer membrane and the first inner liner panel, and a second inner liner panel coupled to and extending between the opposing side faces of the adjacent tab members spaced inwardly from the first inner liner panel forming a second air pocket between the second inner liner panel and the first inner liner panel.

11. The air supported structure of claim 1, wherein the tab members each comprise a single sheet of flexible fabric material.

12. The air supported structure of claim 1, wherein the tab members are formed of the same material as the material forming at least one of the outer membrane and the at least one inner liner panel.

13. The air supported structure of claim 1, further comprising reinforcement cables that transfer loads from the outer membrane to base anchorage, and wherein the tab members do not engage with the reinforcement cables.

14. An air supported structure forming an enclosure over a ground surface via internal pressurized air, comprising:

an outer membrane coupled to a base and extending from the base to an elevated position via the internal pressurized air, the outer membrane defining exterior and interior surfaces of the structure, the interior surface of the outer membrane defining a boundary of the enclosure;

a plurality of tab members formed of a flexible fabric material fixedly coupled to and extending from the interior surface of the outer membrane and into the enclosure, the plurality of tab members each including an attachment portion that extends downwardly into the interior of the enclosure, a plurality of hardware coupled to the attachment portion of the tab members and extending downwardly therefrom into the interior of the enclosure, wherein the exterior surface of the structure is void of the tab members, wherein the attachment portion of each of the tab members comprises a conduit portion that defines an elongate raceway, a plurality of spaced first apertures in the conduit portion that form passageways extending from the raceway to the enclosure, a hardware support portion extending between the conduit portion and at least one inner liner panel, and a plurality of spaced second apertures extending through the hardware support portion positioned proximate to the plurality of spaced first apertures and spaced from the conduit portion, wherein the structure defines a lateral width and a longitudinal length, and the tab members extend at least along the lateral width of the structure such that the attachment portions of the tab members extend from a first lateral side of the structure proximate to a first lateral side of the base to a second lateral side of the structure proximate to a second lateral side of the base, and wherein each hardware extends through the raceway of the conduit portion of one of the tab members, extends through one of the first apertures of the conduit portion, and is coupled to one of the second apertures of the hardware support portion to physically support the hardware.

15. A method of forming an air supported structure that forms an enclosure via internal pressurized air, comprising:

obtaining an outer membrane that defines an outer surface of the structure;

forming a plurality of inner segments by coupling a first end portion of at least one inner liner panel to a medial portion of a first face of a first tab member formed of a flexible fabric material, and a second end portion of the at least one inner liner panel to a medial portion of a second face of a second tab member formed of a flexible fabric material, and fixedly coupling the first and second tab members to an inner surface of the outer membrane such that the at least one inner liner panel extends between the first and second tab members spaced inwardly from the outer membrane and an attachment portion of the first and second tab members extends inwardly past the at least one inner liner panel into an interior of the enclosure;

coupling the outer membrane to a base;

coupling hardware to the tab members such that they extend downwardly therefrom into the interior of the enclosure;

forming pressurized air between the base and the outer membrane to extend the outer membrane from the base to an elevated position via the internal pressurized air to form the enclosure, wherein the attachment portion of each of the tab members comprises a conduit portion that defines an elongate raceway, a plurality of spaced first apertures in the conduit portion that form passageways extending from the raceway to the enclosure, a hardware support portion extending between the conduit portion and the at least one inner liner panel, and a plurality of spaced second apertures extending through the hardware support portion positioned proximate to the plurality of spaced first apertures and spaced from the conduit portion, wherein the structure defines a lateral width and a longitudinal length, and the inner segments extend at least along the lateral width of the structure such that the attachment portions of the tab members extend from a first lateral side of the structure proximate to a first lateral side of the base to a second lateral side of the structure proximate to a second lateral side of the base, and wherein each hardware extends through the raceway of the conduit portion of one of the tab members, extends through one of the first apertures of the conduit portion, and is coupled to one of the second apertures of the hardware support portion to physically support the hardware.

16. The method of forming an air supported structure of claim 15, further comprising forming the conduit portions of the attachment portion of the tab members by bending a first portion of the attachment portion of the tab members over a second portion of the attachment portion and coupling the first and second portions together.

* * * * *